United States Patent [19]

Weavell et al.

[11] 4,346,745

[45] Aug. 31, 1982

[54] WAFER SLICING APPARATUS

[75] Inventors: Jack Weavell; Horst J. Jatzek, both of Coquitlam, Canada

[73] Assignee: CAE Machinery Ltd., Vancouver, Canada

[21] Appl. No.: 181,314

[22] Filed: Aug. 25, 1980

[51] Int. Cl.[3] ..... B27C 1/14

[52] U.S. Cl. ..... 144/176; 144/242 D; 241/92

[58] Field of Search ..... 241/92, 280, 281; 144/162 R, 172, 174, 176, 323, 242 D, 245 A, 242 R; 198/627, 628

[56] References Cited

U.S. PATENT DOCUMENTS

| | | | |
|---|---|---|---|
| 2,936,008 | 5/1960 | Brown | 144/172 X |
| 2,969,095 | 1/1961 | Brookhyser | 144/172 X |
| 3,237,663 | 3/1966 | Kirsten | 144/176 |
| 3,289,719 | 12/1966 | Gunn | 144/176 |
| 3,844,398 | 10/1974 | Pinat | 198/628 |

*Primary Examiner*—W. D. Bray

*Attorney, Agent, or Firm*—Townsend and Townsend

[57] ABSTRACT

A rotatable carrier has a plurality of cutter knives protruding from a work face thereof. A feed passage is positioned to direct longitudinal sides of wood pieces against the carrier face to enable the knives to slice wafers from the pieces during rotation of the carrier. The feed passage is defined by opposed side walls each having a plurality of superimposed gripper chains with runs forming a moving inner surface of the respective wall. These chains are adapted to grip the ends of wood pieces and move said pieces along the passage. The chain arrangement of at least one side wall is mounted in floating relationship to that of the other side wall and is resiliently biased towards the latter.

14 Claims, 9 Drawing Figures

WAFER SLICING APPARATUS

This invention relates to feeding arrangements for apparatus for cutting wafers from pieces of wood for use in the production of waferboards, flakeboards, strand boards and the like.

For years wafers have been cut from wood to be used in the production of waferboard. Although waferizers and wood chippers are somewhat similar in appearance, the type of product produced is quite different. Chippers cut wood mainly across the grain to produce chips used in the production of wood pulp. On the other hand, waferizers cut the wood with the grain to produce wafers or flakes with the grain running longitudinally thereof. These typically are something of the order of 0.25 inch thick and from 1.5 inch to 3 inches long and of random width. The thickness of the wafers is determined by the protrusion of the cutter knives used, the length by the spacing of serrations in the knife cutting edges or by the length of the knives themselves, and the width depends upon how the wafers break off the thin slice of wood being cut from the wood. In order to control the dimensions of the wafers within reason, the wood pieces must be firmly gripped at their ends while the cutter knives are slicing through them.

The present feeding arrangement is an improvement over the arrangements shown in U.S. Pat. Nos. 3,275,049 and 3,289,719 to J. M. Gunn, and U.S. Pat. No. 2,796,094 to M. Himmelheber et al. The apparatus of each of these patents includes a feed passage with opposed side walls each made up of a plurality of gripper chains for moving pieces of wood or logs against a rotating disc having blades protruding therefrom slicing shavings or wafers from the wood pieces.

The apparatus of U.S. Pat. No. 2,796,094 relies mainly on gravity to feed the wood pieces to the cutting disc. The chains forming the side walls of the feed passage engage the sides of the wood pieces so that the latter can roll and shift within the downwardly moving column of wood. Only some of the wood pieces come into contact with the gripper chains. As a result of this, the wood pieces are not positively gripped and held in position when they are being engaged by the cutter knives so that it is impossible to control the thickness and width of the wafers produced.

The feed passages of U.S. Pat. Nos. 3,275,049 and 3,289,719 extend horizontally, and the feed chains of the opposed side walls do grip the ends of the pieces of wood or logs. However, these chains feed the wood pieces to a plurality of horizontal blades which are near the cutting disc. The apparatus of these patents relies on the pieces of wood moved by the chains to move the pieces gripped by the blades along said blades and against the cutter discs. This blade arrangement has not been found to be satisfactory in actual practice, and the blades have been removed from many of the machines on the market.

A disadvantage of all of the devices of the above patents is that during operation of these devices, the walls of the feed passages are fixed relative to each other. These machines would probably act satisfactorily if all of the pieces were exactly the same length, but this is not the case in actual practice. The pieces of wood used in the production of wafers vary considerably in length, even up to 2 or 3 inches. If the passage side walls are positioned so as to grip the longer pieces, it follows that the shorter pieces are not gripped at both ends when they reach the cutter disc. This makes it impossible to slice wafers of relatively constant thickness, length and width. On the other hand, if the passage walls are positioned to grip the shorter pieces, the longer pieces tend to jam in the passage or to lie at an angle to the direction of movement so that they are not parallel with the disc face when the wafers are being cut.

The apparatus of the present invention has a feed passage with horizontal feed chains forming the side walls thereof. An advantage of this invention is that it grips the ends of each piece of wood, maintains the grip right up to the cutter disc face, and holds the piece there while the wafers are being sliced off. However, the most important feature of this invention lies in the fact that the gripper chains of at least one side wall of the feed passage are maintained in floating relationship relative to the chains of the opposite side wall and are biased towards the latter. The floating chain wall is biased at each end thereof so that it will not only move towards and away from the other wall, but its opposite ends can move independently of each other. Thus, wood pieces of different lengths can be gripped simultaneously at opposite ends thereof to be moved sideways towards the cutter disc.

Apparatus in accordance with the present invention comprises a carrier rotatable around a central axis and having a work face, a plurality of cutter knives arranged on the carrier and protruding from the face thereof sufficiently to cut wafers of a substantially predetermined thickness and length during rotation of the carrier, a feed passage positioned to direct longitudinal sides of wood pieces against said carrier face to enable the knives thereof to slice wafers from the pieces during rotation of the carrier, said feed passage being defined by opposed first and second side walls, feed means forming part of each side wall for gripping the ends of wood pieces and moving said pieces along the passage and against the carrier face, and support means for at least the feed means of the first side wall for maintaining the feed means in floating relationship relative to the feed means of the second side wall and resiliently permitting limited movement towards and away from the second wall feed means in order to accommodate pieces of different lengths.

A preferred form of apparatus according to this invention is illustrated in the accompanying drawings, in which:

FIG. 1 is an elevation of this slicing apparatus looking at the feed side thereof, FIG. 2 is a plan view of the apparatus of FIG. 1, FIG. 3 is an end elevation of the apparatus looking at the right hand end of the apparatus in FIGS. 1 and 2, FIG. 4 is an enlarged sectional view taken on the line 4—4 of FIG. 1 through a cutter knife of the apparatus, FIG. 5 is an enlarged horizontal section of the feed passage of the apparatus taken on the line 5—5 of FIG. 1, FIG. 6 is a vertical section taken on the line 6—6 of FIG. 2

Figure 2:
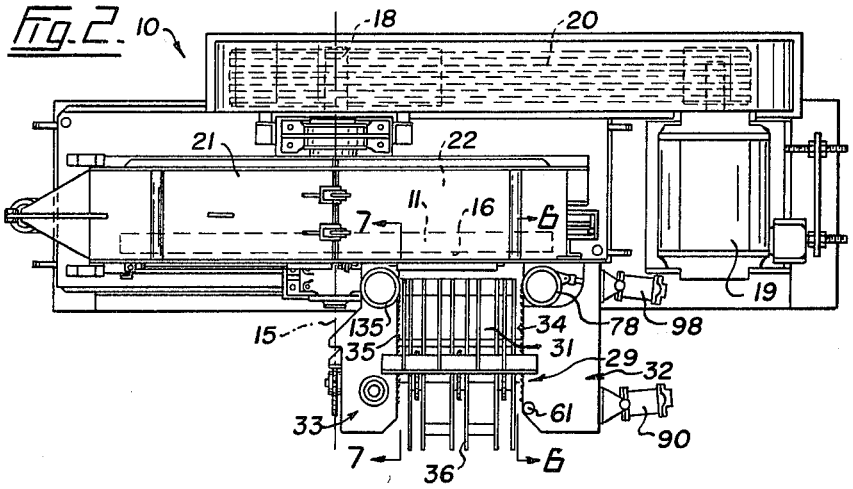

Referring to the drawings, 10 is a wood slicing or waferizing apparatus which includes a carrier or disc 11 mounted for rotation around a horizontal axis 15. The carrier disc has a front or work face 16. In this example, disc 11 is mounted on a shaft 18 which is rotated by an electric motor 19 through a drive system 20. Disc 11 rotates within a relatively large housing 21, said housing forming a chamber 22 behind the disc and having a feed opening 23 on the opposite side of the disc and an outlet opening 24 below the latter.

Pieces of wood, such as small logs, are cut to a length to suit the size of the machine, but generally between about 24 inches and 54 inches, are fed to the work face 16 of disc 11 by a feeder or feedworks generally indicated by the numeral 29 and supported by a base 30. This feeder is made up of a feed passage 31 defined by spaced side walls 32 and 33 having opposed moving inner walls or surfaces 34 and 35, respectively, and a bottom consisting of laterally spaced rails 36 which extend towards the carrier disc 11. The feed passage 31 extends to feed opening 23 of housing 21 to one side of the central axis 15 generally at the level of shaft 18.

Side wall 32 has a top 38 and a bottom 39, and the inner surface 34 of this side wall comprises a plurality of horizontal and vertically arranged feed chains which are mounted in floating relationship to inner surface 35 of side wall 33. The construction of wall 32 and its surface 34 is shown in FIGS. 5, 6, 8 and 9.

The inner surface 34 of wall 32 is made up of a plurality of horizontal superimposed gripper chains 42, each of which extends around sprockets 43 and 44 fixedly mounted on first and second vertical shafts 46 and 47, respectively. The first shaft 46 is located at an inner end of wall 34 as close as possible to the face 16 of cutter disc 11, while the second shaft 47 is located at the opposite end of said wall and spaced outwardly from the disc.

Side wall 32 is mounted on and projects upwardly from the base 30, and shafts 46 and 47 are carried by an inner floating frame generally indicated by the numeral 50 which, in turn, is carried by an outer floating frame 52. Frame 50 comprises horizontal upper and lower inner arms 54 and 55, while frame 52 comprises horizontal upper and lower outer arms 57 and 58 extending near and parallel to arms 54 and 55, respectively. Outer frame 52 is swingably mounted at the outer end 60 thereof on the top 38 and bottom 39 of wall 32 by vertically aligned pivot pins 61 and 62. The inner end 63 of frame 50 is swingably mounted on the adjacent inner end 64 of frame 52 by vertically aligned pivot pins 66 and 67 having a vertical axis 69 common with the axis of shaft 46. With this arrangement, the outer end 71 of inner frame 50 carrying shaft 47 is free to swing around pins 66, 67 and the inner ends 63 and 64 of the inner and outer frames carrying shaft 46 are free to swing around pins 61, 62.

The outer end of lower arm 55 of the inner frame 50 slides on a wear plate 74 carried by lower arm 58 of outer frame 52. Similarly, the inner end of said lower arm 58 slides on a wear plate 75 carried by the bottom 39 of wall 32. In this example, shaft 46 is rotated by an electric motor 78 which is mounted on top of a gear unit 79 carried by the upper arm 57 of frame 52. Motor 78 rotates shaft 46 through gear unit 79, said shaft being operatively connected to the gear unit.

Figures 5, 8, 9:
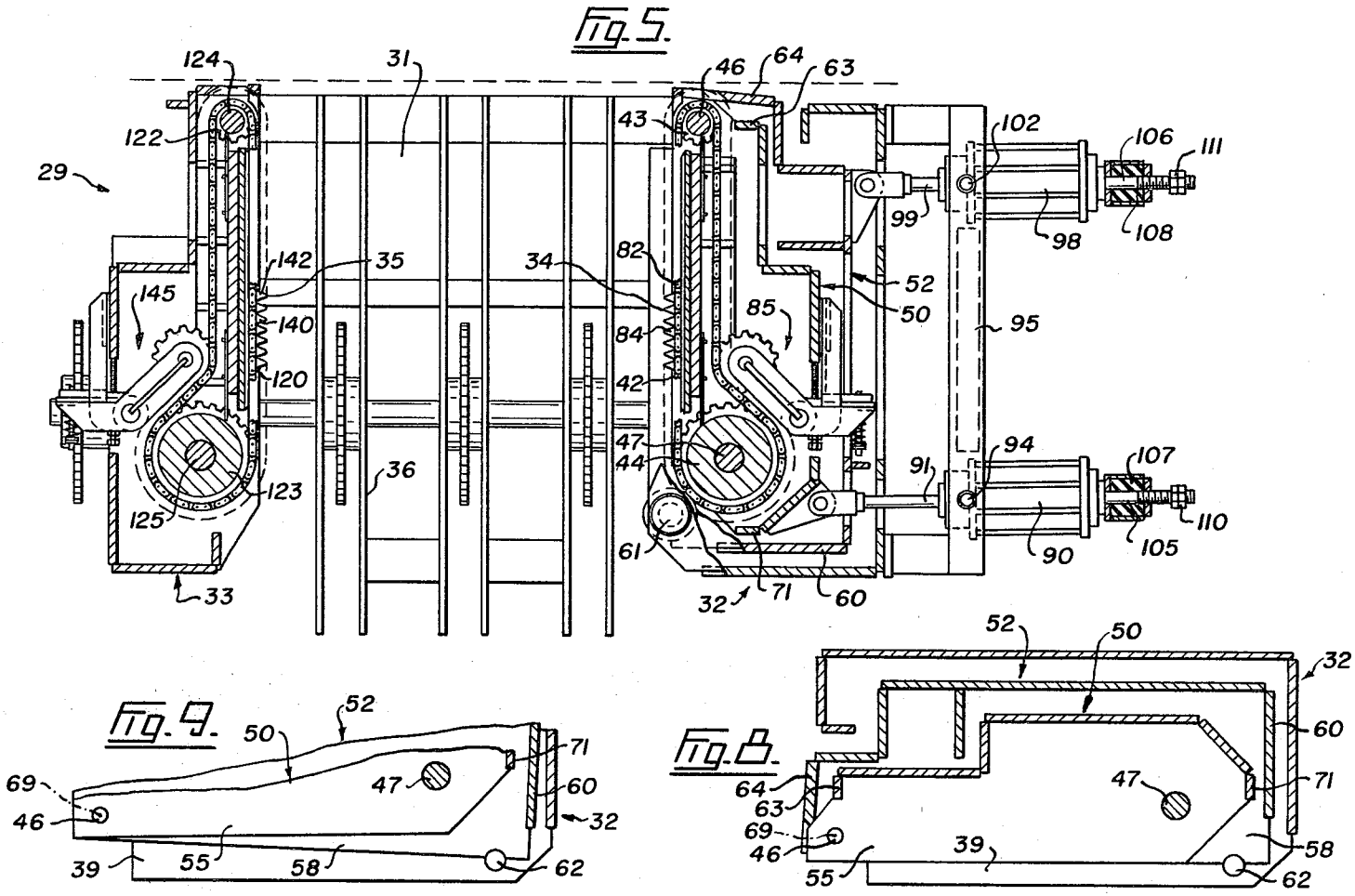
FIG. 8 is a horizontal section taken on the line 8—8 of FIG. 6, showing the floating chain wall at rest.
FIG. 9 is a fragmentary view similar to FIG. 8 showing the floating chain wall in a position out of the at rest position.
Figure 6:
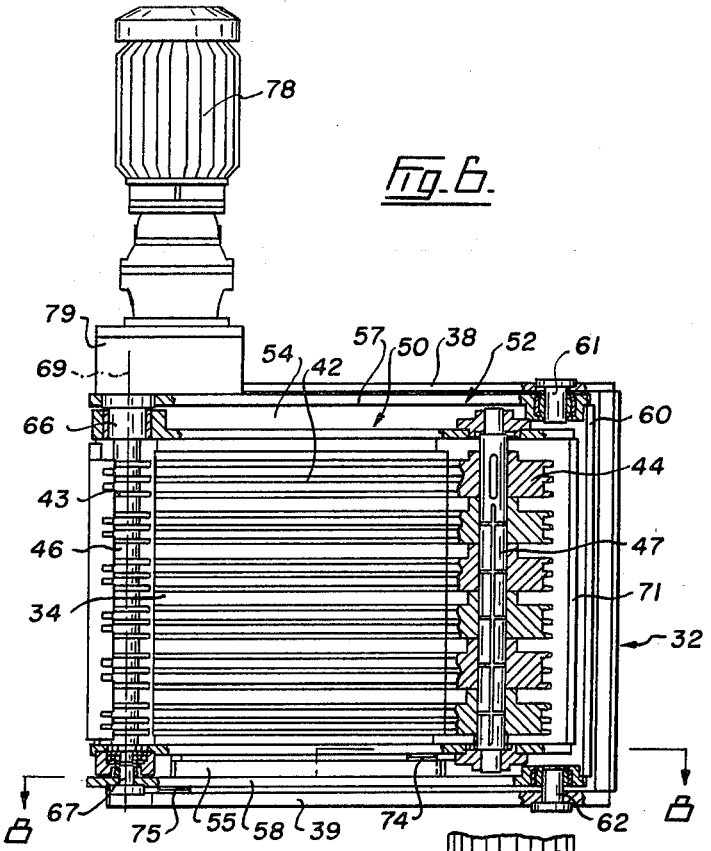

FIG. 5 shows one of the gripper chains 42 which extends around its sprockets 43 and 44. This chain is horizontally arranged, and has an inner run 82 which extends along the side of feed passage 31, and the runs 82 of all the chains 42 combine to form an effective movable inner surface of wall 32 along the feed passage. Each chain 42 has a plurality of gripper lugs 84 projecting outwardly therefrom. In this example, each sprocket 43 of each chain 42 is smaller than the sprocket 44 of said chain, and a chain tightener assembly 85 engages each chain to maintain is relatively tight.

Suitable means is provided for biasing the floating inner frame 50 in the direction of feed passage 31. In this example, an air spring in the form of an air cylinder 90 has a piston rod 91 projecting therefrom and pivotally connected at an outer end of the frame 50 and thereby to inner arms 54 and 55 adjacent the outer ends thereof. The cylinder is swingably connected by means of pins 94 to a support 95 mounted on and projecting laterally from wall 32. Another air spring in the form of an air cylinder 98 has a piston rod 99 projecting therefrom and pivotally connected at its outer end to the outer frame 52 and thereby to the inner ends of the outer arms 57 and 58 near the inner ends thereof. Cylinder 98 is pivotally connected by pins 102 to support 95. The cylinders 90 and 98 are mounted so that they are free to swing horizontally to a limited degree. Air springs 90 and 98 are arranged to bias their respective piston rods 91 and 99 towards the feed passage 31 and, consequently, bias the outer arms 57, 58 and inner arms 54, 55 of the floating frames 52 and 50 in the same direction. The piston rods 91 and 99 extend through their respective cylinders and have end sections 105 and 106 extending freely through resilient bumper pads 107 and 108 carried by the outer ends of the respective cylinders. Stops 110 and 111 on end sections 105 and 106 engage the bumper pads 107 and 108 to limit the inward movement of piston rods 91 and 99 and, consequently, the floating frames 50 and 52.

Figure 7:
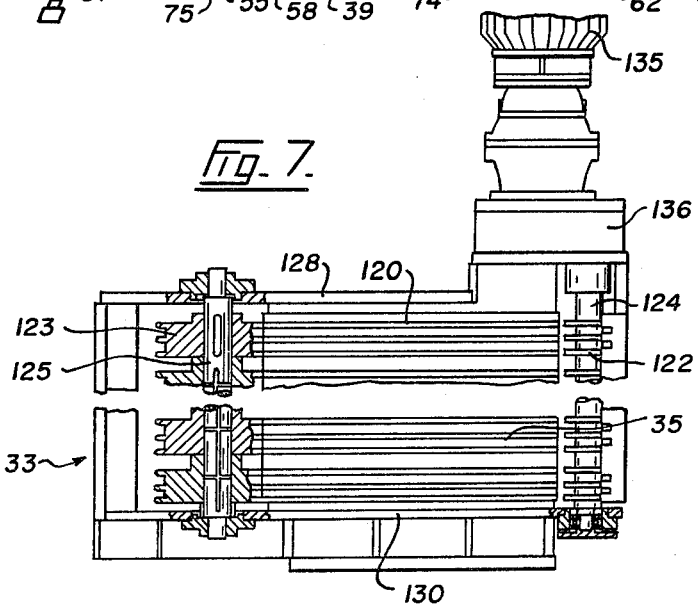
FIG. 7 is a vertical section taken on line 7—7 of FIG. 2.

Wall 33 on the opposite side of feed passage 31 from wall 32 is similar to the latter wall, excepting that the chains of wall 33 are not floating relative to wall 32. Wall 33 is shown in FIGS. 5 and 7, and is made up of a plurality of horizontal gripper chains 120 extending around inner and outer sprockets 122 and 123 respectively mounted on vertical shafts 124 and 125. These shafts are carried by suitable bearings in the top and bottom 128 and 130 of wall 33. Shaft 124 and its sprockets 122 are driven by an electric motor 135 through a gear unit 136 operatively connected to the upper end of shaft 124.

Each chain 120 has an inner horizontal run 140, see FIG. 5, which extends from its sprocket 124 to sprocket 122, and the chain has gripper lugs 142 projecting outwardly therefrom. The horizontal runs 140 of chains 120 form the effective inner surface of wall 33 along feed passage 31. Tightener assemblies 145 mounted in wall 33 keep the chains 120 tight around their respective sprockets.

Although the gripper chains of wall 33 are not floating, it is obvious that they can be mounted in the same manner as chains 42 of wall 32 so as to be floating as well as or instead of said chains 42.

Figure 1:
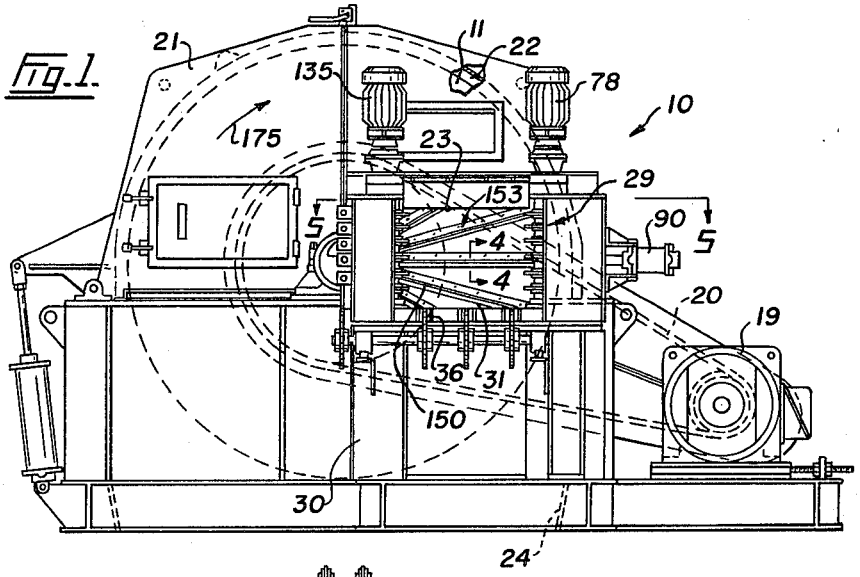
Figure 3:
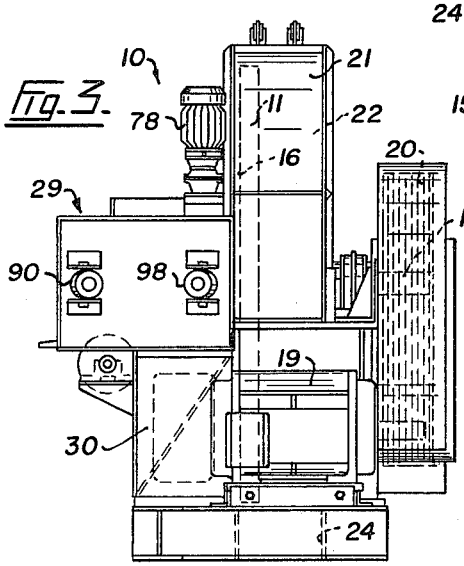
Figure 4:
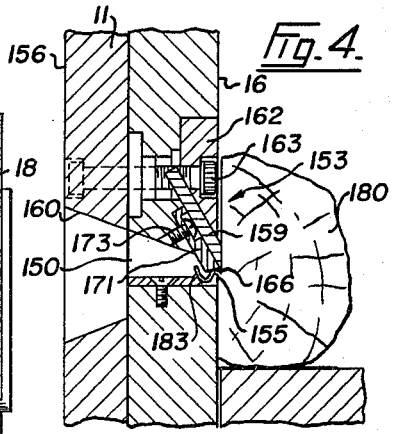

Carrier disc 11 has a plurality of circumferentially spaced substantially radial slots 150 therethrough with a waferizing arrangement 153 at each slot, see FIGS. 1 and 4. Any suitable waferizing arrangement may be used in disc 11. In the illustrated example, each slot 150 has a narrower entrance 155 opening out from the work face 16 of disc 11. The slot widens towards the rear surface 156 of the disc. This wafer arrangement includes a cutter knife 159 which is located at one side 160 of the slot. The knife is gripped and held in place by a standard knife clamp 162 which is held in place by a plurality of bolts 163. Knife 159 has a bevelled cutting edge 166. This cutting edge protrudes slightly beyond the work surface 16 of the carrier disc at the entrance 155 of slot 150. The position of the knife cutter edge relative to the disc surface determines the thickness of the wafers being cut, this protrusion being something of the order of 0.025 inch. The cutter knife may have the usual serrations, not shown, in the cutting edge thereof, the spacing of these serrations, or the length of the knife, determining the length of the wafers in the usual manner. If desired, a counterknife 171 may be provided, this counterknife being held by a screw 173 against a portion of carrier 11 near slot 150 and extends throughout the length of knife 159.

During operation of apparatus 10, carrier disc 11 is rotated by motor 19 in the direction of arrow 175 in FIG. 1. This causes the slots 150 of the disc to move downwardly past the feed opening 23 in housing 21. The feed chains of the wall 32 and 33 on the opposite sides of feed passage 31 grip ends of pieces of wood 180 and move these pieces horizontally against the work face 16 in the manner hereinafter described. With this arrangement, one or more wood pieces 180 is or are pressed against the work face of the carrier disc. As each cutter knife 159 moves past a piece 180, the cutting edge 166 cuts a slice 183 from the wood, see FIG. 4. At this time, the cutting edge moves downwardly through the wood while extending substantially parallel to the grain thereof. The thickness of this slice depends upon on the amount of protruberance of cutting edge 166 of the cutter knife.

The wood pieces 180 are directed into feed passage 31 in any desired manner. However, they must be delivered to the passage so as to extend transversely thereof. The wood pieces are moved into the passage far enough to enable the lugs of the side wall chains 42 and 120 to grip the ends thereof. As the frames 50 and 52 of wall 32 are floating, the chains 42 are biased inwardly of the feed passage by air springs 90 and 98. The inward movement of the chain runs 82 (the inner surface of wall 32) is limited by stops 110 and 111 on the extensions of piston rods 91 and 99. These stops are adjusted so that then the gripper chains are in their innermost position, they will grip the adjacent end of the shortest piece that will be supplied to the feed passage. This pushes the piece transversely of the passage so that its opposite end is gripped by chain 120 of wall 33. If a relatively long piece follows a short piece, the outer end of the chain wall 32 is pressed laterally against the pressure of spring 90. This inclines the chain wall so that the larger piece is accommodated without necessarily letting go of the short piece. As the long piece progresses towards the feed opening 23 of the machine, the opposite or inner end of the chain wall can swing outwardly while maintaining the grip on the wood. The actual action of the chain wall can be understood by an examination of FIGS. 6, 8 and 9. When it is necessary for the outer end of the chain wall to swing laterally, the inner arms 54 and 55 swing about pivot pins 66, 67 against air spring 90. As the piece that forced the outer end of the chain wall outwardly progresses along the feed passage, the outer arms 57 and 58 swing around pivot pins 61 and 62 against the action of air spring 98 so their inner ends and the inner ends of arms 54 and 55 swing outwardly relative to feed passage. If necessary, the outer end of the chain wall can swing inwardly or outwardly at this time. In other words, the opposite ends of the inner chain surface of wall 32 can swing laterally relative to the feed passage and wall 33 independently of each other. This action practically eliminates the possibility of a piece of wood moving along the passageway towards the cutter disc and not be gripped by the gripper chains of the opposed passage walls. As a result of this, the wood pieces are firmly gripped at their ends at the time they are pressed against the cutting disc and while the cutter knives are cutting wafers off them. The inner ends of the two passage chain walls are located right at the cutter disc face so that the chains keep their grip on the wood pieces during the cutting action.

I claim:

1. Apparatus for slicing from longitudinal sides of elongate wood pieces having grain running substantially from end to end thereof, relatively long and thin wafers with longitudinally extending grain, said apparatus comprising a carrier rotatable around a central axis and having a work face, a plurality of cutter knives arranged on the carrier and protruding from the face thereof sufficiently to cut wafers of a substantially predetermined thickness and length during rotation of the carrier, a feed passage positioned to direct longitudinal sides of wood pieces against said carrier face to enable the knives thereof to slice wafers from the pieces during rotation of the carrier, said feed passage being defined by opposed first and second side walls each side wall having an inner end adjacent the carrier and an outer end remote from the inner end, feed means forming part of each side wall for gripping the ends of wood pieces and moving said pieces along the passage and against the carrier face, and support means for at least the feed means of the first side wall for maintaining the feed means in floating relationship relative to the feed means of the second side wall and resiliently permitting limited movement towards and away from the second wall feed means and permitting the ends of the first side wall to be moved independently of each other to accommodate pieces of different lengths in the feed passage at the same time.

2. Slicing apparatus as claimed in claim 1 in which said feed means of each side wall comprises a plurality of superimposed movably mounted gripper chains so mounted on said each wall as to have lengths forming an effective surface of the respective wall facing inwardly of the passage, said chain lengths gripping ends of wood pieces in the passage, and power means operatively connected to the chains to move said wall-forming lengths in the direction of the carrier.

3. Slicing apparatus as claimed in claim 2 in which each gripper chain comprises an endless chain extending around a first sprocket located close to the carrier face and a second sprocket spaced outwardly away from the carrier, and gripper lugs on and projecting outwardly from said chain, said power means being connected to one of said sprockets to rotate the latter sprocket.

4. Slicing apparatus as claimed in claim 1 in which said support means comprises an air spring connected to the feed means of the first side wall to bias said feed means towards a normal position at the side of the feed passage.

5. Apparatus for slicing from longitudinal sides of elongate wood pieces having grain running substantially from end to end thereof, relatively long and thin wafers with longitudinally extending grain, said apparatus comprising a carrier rotatable around a central axis and having a work face, a plurality of cutter knives arranged on the carrier and protruding from the face thereof sufficiently to cut wafers of a substantially predetermined thickness and length during rotation of the carrier, a feed passage positioned to direct longitudinal sides of wood pieces against said carrier face to enable the knives thereof to slice wafers from the pieces during rotation of the carrier, said feed passage being defined by opposed first and second side walls each side wall having an inner end adjacent the carrier and an outer end remote from the inner end, feed means forming part of each side wall for gripping the ends of wood pieces and moving said pieces along the passage and against the carrier face, support frame means in the first side wall and carrying the feed means of said first wall, and resilient means for maintaining the frame means and the feed means thereof in floating relationship relative to the feed means of the second side wall and resiliently permitting limited movement towards and away from the second wall feed means and permitting the ends of the first side wall to be moved independently of each other to accommodate pieces of different lengths in the feed passage at the same time.

6. Slicing apparatus as claimed in claim 5 in which said feed means of each side wall comprises a plurality of superimposed movably mounted gripper chains so mounted on the frame means of the first wall or on the second wall as to form lengths forming an effective surface of the respective wall facing inwardly of the passage, said chain lengths gripping ends of wood pieces in the passage, and power means operatively connected to the chains to move said wall-forming lengths in the direction of the carrier, the power means of the first wall being carried by the frame means thereof.

7. Slicing apparatus as claimed in claim 6 in which each gripper chain comprises an endless chain extending around a first sprocket located close to the carrier face and a second sprocket spaced outwardly away from the carrier, and gripper lugs on and projecting outwardly from said chain, said power means being connected to one of said sprockets to rotate the latter sprocket.

8. Slicing apparatus as claimed in claim 5 or 6 in which said resilient means comprises an air spring connected to the frame means of the first side wall to bias the feed means thereof to a normal position extending along the feed passage, said air spring allowing a limited movement of the frame means and the support means away from the passage.

9. Slicing apparatus as claimed in claim 5 or claim 6 in which said resilient means comprises a plurality of air springs connected to the frame means of the first side wall to bias the feed means thereof to a normal position extending along the feed passage, said air springs allowing a limited movement of the frame means and support means away from the passage.

10. Slicing apparatus as claimed in claim 5 or 6 in which said resilient means comprises a first air spring connected to the frame means of the first side wall near one end thereof adjacent the carrier work face, and a second air spring independent of the first air spring and connected to said frame means near an opposite end thereof, said air springs biasing the feed means of the frame means to a normal position extending along the feed passage, and allowing the opposite ends of said frame means a limited movement away from the passage independently of each other.

11. Slicing apparatus as climed in claim 5 in which said support frame means comprises an outer frame and an inner frame, said outer frame having parallel upper and lower outer arms extending substantially parallel to the feed passage, first pivot means connecting outer ends of the outer arms to the first wall to allow horizontal movement of opposite inner ends of said outer arms, said inner frame having parallel upper and lower inner arms extending substantially parallel to the outer arms, second pivot means connecting the inner ends of the outer arms to adjacent inner ends of the inner arms to allow horizontal movement of opposite outer ends of said inner arms, said feed means of the first side wall extending longitudinally of and being carried by said upper and lower inner arms.

12. Slicing apparatus as claimed in claim 11 in which said feed means of each side wall comprises a plurality of superimposed movably mounted gripper chains so mounted on the inner frame of the first wall or on the second wall as to form lengths forming an effective surface of the respective wall facing inwardly of the passage, said chain lengths gripping ends of wood pieces in the passage, and power means operatively connected to the chains to move said wall-forming lengths in the direction of the carrier, the power means of the first wall being carried by the outer frame thereof.

13. Slicing apparatus as claimed in claim 12 in which the gripper chains of the first side wall extend around sprockets mounted on vertical shafts carried by said upper and lower inner arms of the inner frame adjacent opposite ends of said inner arms, the longitudinal axis of one of said shafts coinciding with the axis of said second pivot means.

14. Slicing apparatus as claimed in claim 12 or 13 in which said resilient means comprises a first air spring connected to said inner frame adjacent the outer ends of the inner arms thereof, and a second air spring connected to said outer frame adjacent the ends of the inner and outer arms near the second pivot means interconnecting said inner and outer arm ends, said first spring and said second spring independently biasing the arm ends of the frames to which they are connected to normal positions adjacent the feed passage and allowing limited movement of said arm ends away from the passage.

* * * * *